United States Patent [19]

MacNamara et al.

[11] Patent Number: 4,526,264

[45] Date of Patent: Jul. 2, 1985

[54] ELECTRICALLY OPERATED CARD DISPENSER

[76] Inventors: Barry A. MacNamara; John H. Garde, both of 861 Ann St., Fortitude Valley, Brisbane, Queensland, Australia

[21] Appl. No.: 595,301

[22] Filed: Mar. 30, 1984

[51] Int. Cl.[3] ..... G07F 5/16

[52] U.S. Cl. ..... 194/1 N; 221/129

[58] Field of Search ..... 194/1 N, 1 G, 1 M; 221/129, 125, 126, 127

[56] References Cited

U.S. PATENT DOCUMENTS 3,445,035 5/1969 Ackerman ..... 221/129

*Primary Examiner*—Stanley H. Tollberg

*Attorney, Agent, or Firm*—Richard H. Stern

[57] ABSTRACT

An automatic coin-operated card dispenser is provided in which solid state circuitry is utilized to cause the delivery of cards or tickets to customers from several vertical card stacks. Deposit of a coin causes a power pulse to be delivered to a geared motor which drives a slide plate forward to push a card from a card stack. The motion of the slide plate releases a power switch that powers the motor for the remainder of the cycle, whereupon the power switch is turned off until a new power pulse occurs.

9 Claims, 6 Drawing Figures

ELECTRICALLY OPERATED CARD DISPENSER

BACKGROUND OF THE INVENTION

1. Field of the Invention

The present invention relates to automatic coin-operated card or ticket dispensing machinery. More particularly it concerns an improved and more reliable machine for electrically dispensing cards or tickets from several columns without the occurrence of down time due to jamming.

2. Discussion of prior art

Prior devices for dispensing tickets or cards from a column or stack have typically relied on complex mechanisms that include noisy and unreliable components such as solenoids. For example, Ackerman's automatic coin-operated card dispenser (U.S. Pat. No. 3,445,035) uses a cam activated pusher plate to push bingo or lottery cards from stacks in which the cards are horizontally disposed. It also contains a continuously operating electric motor driving a conveyor belt and a set of nip rollers, solenoids to cock a pusher plate mechanism, switches activated by the motion of the pusher plates, a switch-activated clutch, and cams activated by the clutch closure.

Such devices are inherently unreliable because they have many moving components. Any one of the components may fail. Moreover, all of these components must be kept in proper timing and proper alignment adjustment with respect to one another. When timing or alignment of the components is off, the machine will at best not operate and may even become damaged if the internal parts collide with one another. Resulting down time causes loss of sales and also the cost of making service calls.

A further characteristic of prior card dispensing machines has been a problem created when one of the stacks of cards becomes exhausted or jammed. When this happens, the customer loses his coin and becomes annoyed. Someone must place an "out of service" sign on the machine. Jamming may also necessitate service calls. Finally, the noisiness of prior machines is objectionable in many locations and thus a reason against permitting the machines to be placed and kept in such locations.

BRIEF SUMMARY OF INVENTION

It is an object of the present invention to provide a ticket or card dispensing machine with few moving parts, and one not needing or minimizing critical alignment and timing adjustments. It is another object of the invention to provide a machine with reliable components that are unlikely to fail or need frequent servicing. It is another object of the invention to avoid annoyance to customers from the machine's confiscating the customer's coin without dispensing the card (the term "card" is used hereafter to mean tickets as well as cards) that the customer believes that he paid for. A further object of the invention is to eliminate unpleasant noises during operation and instead to provide pleasant sounds.

The invention described below accomplishes these objectives by providing a largely nonmechanical system based on solid state devices which, unlike the prior art's completely mechanical parts, do not need complex timing and alignment adjustments. The improved system of this invention does not rely on noisy solenoids or relays. It eliminates conveyor belts, rollers, and the like.

Instead of relying on a large number of mechanical adjustments, the improved system operates primarily by means of switch or potentiometer controls; and it includes means for defeating the adverse effects of jam-ups in the ticket stacks.

DESCRIPTION OF THE PRESENT INVENTION

Figure 1:
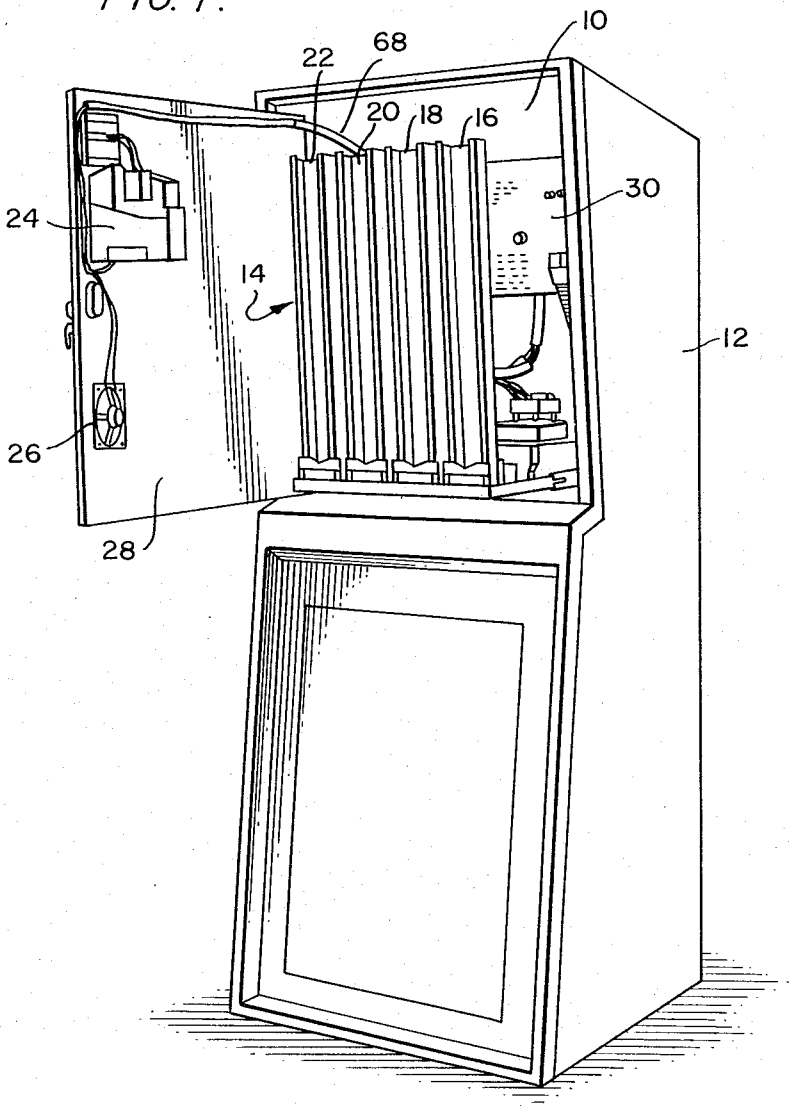
FIG. 1 is a perspective view of the inside of the cabinet, from a vantage point to the right of the opened front door of the cabinet.

A perspective view of a preferred embodiment of the present invention may be seen in FIG. 1. A card-dispensing system 10 is shown mounted within an opened up main frame or cabinet 12 of the machine. System 10 includes card stack module 14, which can typically include four card stacks 16, 18, 20, and 22. (However, the present commercial embodiment of this system uses three stacks.) Card dispensing system 10 also includes coin acceptor module 24 and loudspeaker 26, which are mounted on the inside of door 28 of cabinet 12. System 10 also includes motor control printed circuit board module 30, which is mounted to the upper rear inside of cabinet 12. Upper wiring cable 68 (shown more advantageously in FIG. 3) connects loudspeaker 26 and coin acceptor module 24 to printed circuit board module 30.

Figure 2:
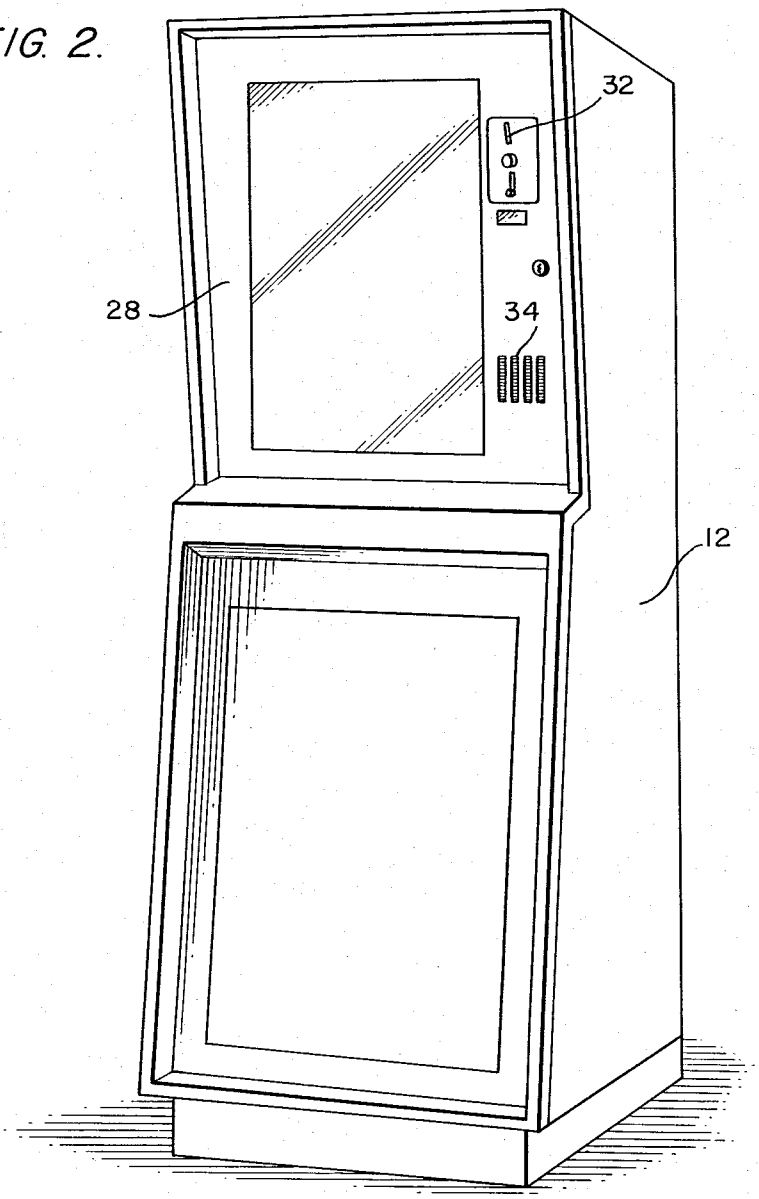
FIG. 2 is a perspective view of the outside of the cabinet from a similar vantage point.

An external view of cabinet 12 is shown in FIG. 2, with door 28 closed. Coin slot 32 is shown mounted in door 28, and it feeds into coin acceptor module 24 of FIG. 1. Loudspeaker grill 34 is shown in FIG. 2 as part of door 28, and it is directly in front of loudspeaker 26 of FIG. 1.

Figure 3:
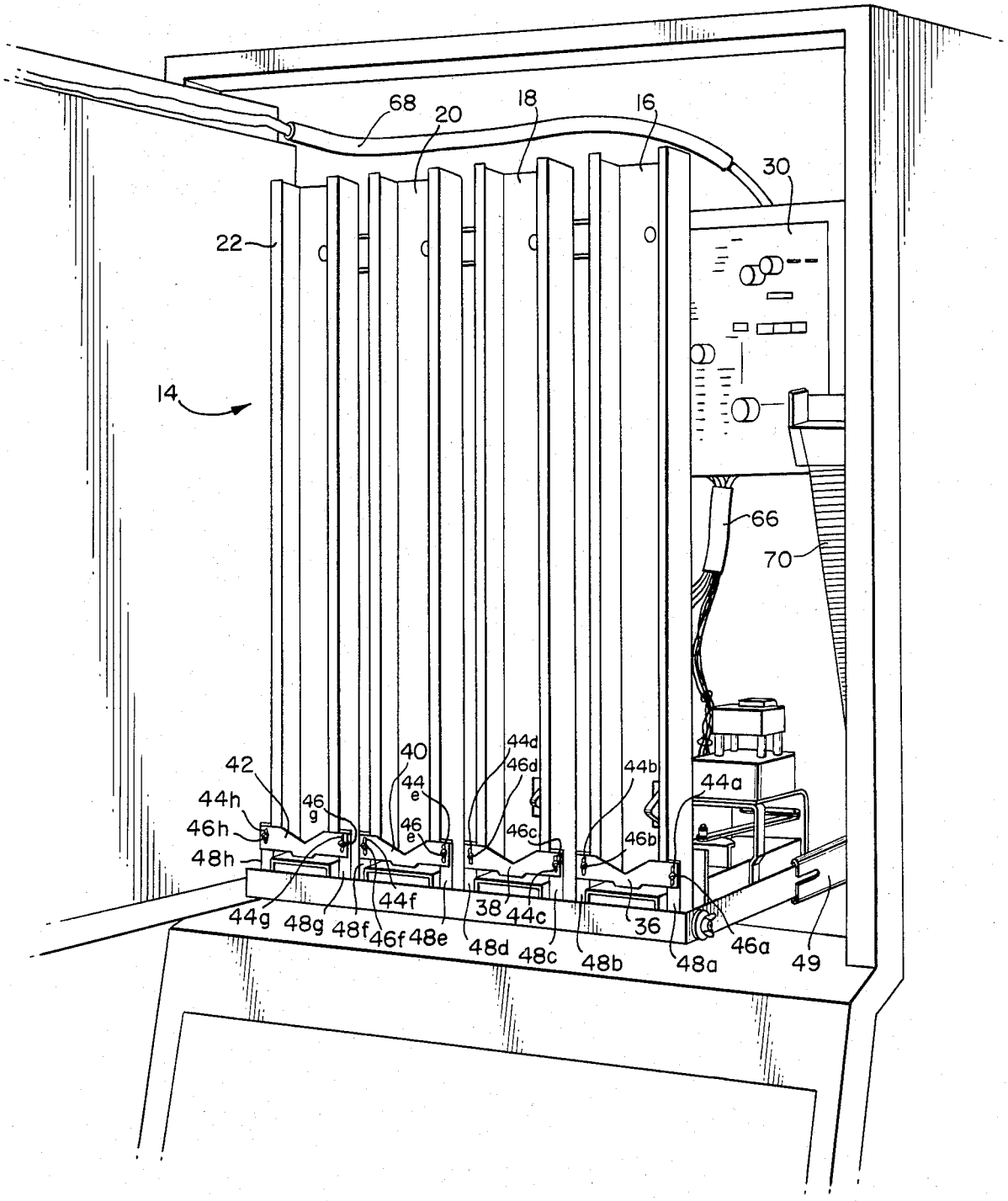
FIG. 3 is a perspective detailed view of the card stacks shown in FIG. 1, with associated equipment.

A detail of card stack module 14 is shown in FIG. 3, together with nearby parts. Four identical meter bars 36, 38, 40, and 42, located at the front and bottom of the four card stacks, 16, 18, 20 and 22, are upwardly and downwardly adjustable by means of slots 44*a* through *h* and adjustment screws 46*a* through *h*. The adjustment screws are mounted in the slots and fasten meter bars 36 through 42 to slotted brackets 48*a* through *h*. Brackets 48*a* through *h* are mounted to the upper bottom of card stack module 14, which is mounted to cabinet 12 by means of a telescoping slide 49 (so that card stack module 14 can be slid forward to service it or replenish cards). Meter bars 36, 38, 40, and 42 may be adjusted upward or downward to accommodate different thicknesses of cards. The meter bars provide a predetermined clearance at the bottom of the card stacks (i.e., one card thickness) such that only one card can be pushed out of the stack at a time. (The pushing is done by means of a slide plate 50 described below.)

Referring again to FIG. 3, motor control printed circuit board module 30 is shown behind card stack module 14. Lower cable 66 (shown below motor control printed circuit board module 30) is a bundle of connectors that connects between printed circuits board module 30 and portions of card stack module 14. Upper wiring cable 68 (shown above card stack module 14) connects coin-acceptor module 24 to motor control printed circuit board module 30. Power cable 70 (to the right of motor control printed circuit board module 30) delivers 110 v, 60 Hz power to the system via printed circuit board module 30 and other components.

Figure 4:
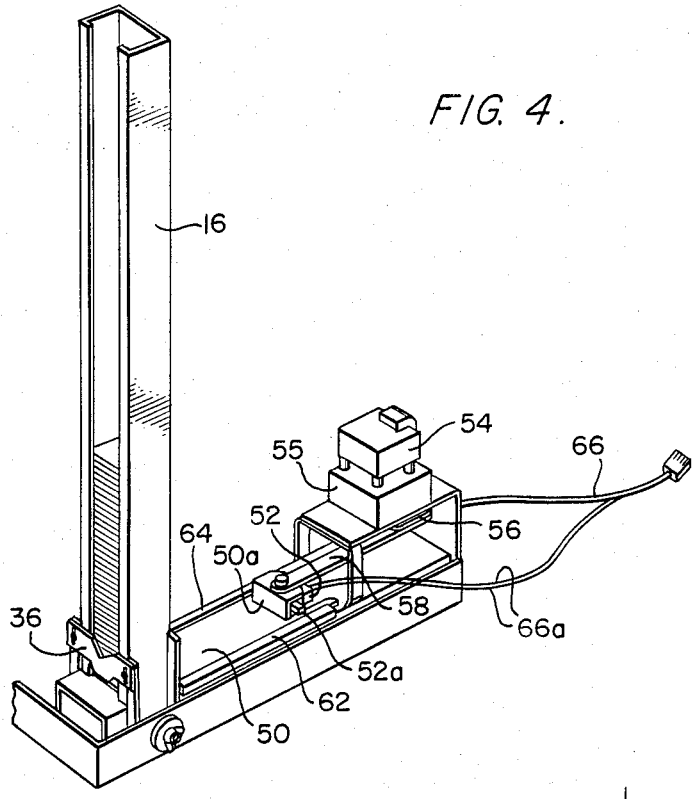
FIG. 4 is an enlarged detail view of one of the card stacks shown in FIG. 3.

A further detail of one card stack of card stack module 14 is shown in FIG. 4. (The other card stacks are identical). The equipment for driving cards out of the card stacks (the card driver unit) is as follows: Slide plate 50 is shown in FIG. 4 in the "home" or inactive position, i.e., fully retracted to the right. When plate 50 is in this position, a power delivery circuit of microswitch 52, which is mounted on the upper bottom of card stack module 14, is in the "off" position (open circuit). This is because the rear part of plate 50 (shown as element 50*a*) presses closed microswitch handle 52*a* (shown more advantageously in FIG. 6). The power delivery circuit of microswitch 52 is open circuit when the handle is closed and it is closed circuit when the handle is released. Wires 66*a* feed power from cable 66 to microswitch 50 and motor 54.

Also shown in FIG. 4 is motor 54, which is normally turned off and not running when slide plate 50 is in the "home" position. Motor 54 drives gearbox 55, which in turn drives eccentirc arms 56 and 58. (The motor and gearbox can be combined as a gearmotor. In the intended commercial embodiment of the invention, the motor and gear system is Dayton gearmotor #3M099, which effectuates a speed reduction from approximately 2400 r.p.m. to approximately 18 to 20 r.p.m., and has been found to deliver enough torque to operate the card driver unit. A belt and pulley system would be an equivalent means of effecting speed reduction, but it is considered less reliable.)

Figure 5:
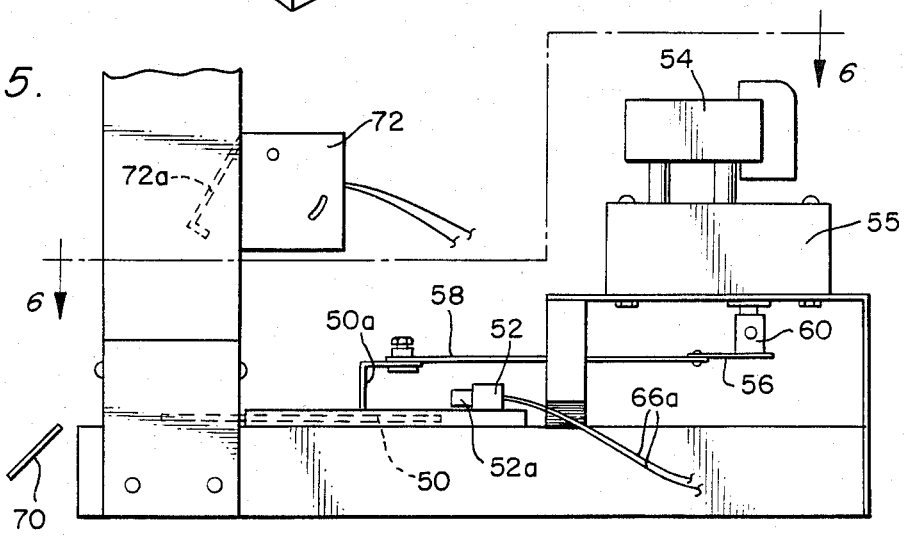
FIG. 5 is a side view of the card stack of FIG. 4.

The output shaft of gearbox 55 is mounted to coupling 60 (shown more advantageously in FIG. 5). Eccentric arm 56 is mounted at one end to coupling 60. The other end of arm 56 is pivotally connected to one end of eccentric arm 58, and the other end of arm 58 is pivotally connected to slide plate 50. (Alternative or equivalent devices for converting rotary to longitudinal motion will be obvious to those familiar with machine design. The term "eccentric unit" is intended to comprehend all such means.) Rails 62 and 64 laterally surround plate 50. Thus, eccentric arms 56 and 58 can longitudinally drive plate 50 between rails 62 and 64 when motor 54 rotates and arms 56 and 58 therefore move. Accordingly, the operation of motor 54 causes slide plate 50 to press to the left against the bottom back part of the card stack and thus drive a card out of the card stack, for delivery to the customer, and the operation of the motor returns plate 50 to the "home" position.

Figure 6:
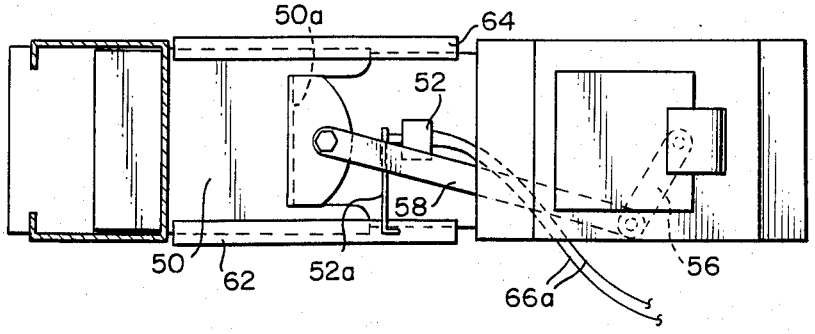
FIG. 6 is a top view of the same card stack.

FIGS. 5 and 6 are side and plan views of the detail of one card stack that is shown in FIG. 4. However, slide plate 50 is shown in FIGS. 5 and 6 in an operating position, i.e., about one third of the way through a full cycle, rather than in the "home" position as in FIG. 4. Thus, in FIGS. 5 and 6, microswitch handle 52*a* is open rather than closed, since rear part 50*a* of slide plate 50 is not pressing handle 52*a* into the closed position.

GENERAL OPERATION OF SYSTEM

The general operation of the system occurs as follows: A customer inserts a coin (such as a quarter) into coin slot 32. Coin acceptor module 24 transmits a coin-acceptance singal (pulse) to motor control printed circuit board module 30 (described in greater detail below). A pulse is generated within printed circuit board module 30 and it causes a 110 vac, 60 Hz power pulse to be transmitted for about one second to trigger the operation of the motor of one of the card stacks in card stack module 14. The coin acceptor may be fed several coins rather than only one coin. Module 30's circuitry counts the number of coin acceptance signals and will cause delivery of a power pulse to start a motor again for a new cycle as many times as there were coins deposited.

Because printed circuit board module 30 operates at 5–12 vdc, and the motor operates at 110 vac, it is desirable to provide an isolating interface. This is advantageously done by using optoisolators (Motorola MC 3010) to drive triacs (400 vac, 2*a*), and the triacs control the motors with which they are respectively in series. Thus, a 12 volt pulse from printed circuit board 30 drives an optoisolator, which drives a triac, which controls one motor.

Referring now to FIGS. 4 to 6, it is seen that supplying a power pulse to motor 54 via the triac starts the operation of motor 54. The rotation of motor 54 then drives gearbox 55, which in turn moves eccentric arms 56 and 58. The eccentric arms convert the rotary motion of the motor and gearbox to a longitudinal motion, so as to move slide plate 50 forward between rails 62 and 64 and out of the "home" position. The movement of plate 50 after less than about one second releases microswitch handle 52*a*, causing the power delivery circuit of microswitch 52 to become close-circuited. (Microswitch 52 can advantageously be a 2-circuit, one No and one NC, device so that a separate signal circuit is available to send a signal to printed circuit board 30 that the motor has started to drive slide plate 50 forward.) This change of state of microswitch 52 must occur before the one-second pulse from printed circuit board module 30 has terminated, because when that pulse terminates the triac stops supplying power to the motor. Thereafter, power is supplied to motor 54 by means of the microswitch and wires 66*a*, rather than via the triac. (Alternatively, the change in state of the microswitch can be fed to printed circuit board module 30, which can signal the triac to deliver power.)

Plate 50 moves forward and eventually pushes card 70 (shown only in FIG. 5) out of the card stack when plate 50 is all the way forward, which occurs after about 1.5 to 2 seconds. (Plate 50 is not shown all the way forward in FIGS. 5 and 6.) The motorgearbox-eccentric assembly continues to drive plate 50 through the cycle, until plate 50 returns to the "home" position, whereupon rear part 50*a* of plate 50 presses microswitch handle 52*a* into the closed position, thereby opening the microswitch circuit that was controlling the delivery of power to the motor via wires 66*a* and thereby the motor is turned off and the motion of plate 50 stops. (The original trigger pulses from printed circuit board module 30 and the triac will have terminated well before this point in the cycle is reached, so that the motor stops.) The entire cycle takes about three seconds.

It is contemplated that the system will operate with horizontally disposed vertical stacks of cards and that the bottommost card will be dispensed—the system thus takes advantage of the force of gravity. However, any orientation angle could be used, with spring loading of the cards if necessary. Thus, the equivalent of the present system could be devised in which the card stack could be upside down or at an angle. The system is described herein and in the claims in terms of use of gravity, but the other approaches are intended to be comprehended as equivalents.

Another feature of the contemplated commercial embodiment of the system is that module 30 also causes music to be played. That is, each time a pulse is sent to actuate motor 54, a signal is also sent to actuate the music circuit (located as part of printed circuit board 30), which acts as a musical tune generator and generates audio signals constituting a preselected tune which is then played through loudspeaker 26. A melody chip of the type used for door chimes (e.g., Epson America, No. 7910 series) may advantageously be used as a musical tune generator. In the contemplated commercial embodiment, 24 different tunes are available in the circuit and the different tunes are played in sequence. However, other arrangements are possible, so that a different tune can be associated with each stack of cards, or tunes can be randomly selected.

Another feature of the system is an anti-jamming device. A card stack may become jammed; usually this occurs only if the cards are not loaded properly or if one of them is bent or torn out of shape. First of all, the motor is fuse protected, so that a jam-up binding slide plate 50 will not burn out motor 54. In addition, the circuitry of printed circuit board module 30 "recognizes" that the particular card stack module is jammed and passes it by (as described below). Thus the machine continuous to function normally, using the other stacks. It is not necessary for a service person to put an "out of order" sign on the machine; there is no down time; and it is not necessary to service the machine to remove the bent card or otherwise fix the jam-up, until all of the other card stacks are exhausted.

Another feature of the system is that when any one card stack is empty, a microswitch (or other "out" detection device) near the bottom of the stack is released. Such a microswitch is shown as 72 in FIG. 5. Handle *72a* of switch 72 is depressed when cards are in the stack. But when no cards press handle *72a* closed, it opens as shown in FIG. 5. This sends an "out" signal to printed circuit board module 30 to bypass the exhausted stack. (The same effect occurs if a jam-up blocks cards from descending to the bottom of a card stack. After the last card below the jam-up is dispensed, the card stack appears empty to the "out" detection device.) If the out detector microswitches of all card stacks are in the released handle position, a resulting "sold out" signal turns on a "sold out" light on the front of the cabinet and causes a barrier to close behind coin slot 32, so that it will not accept any more coins. (E.g., a bar is released by an electromagnet.)

It has been found advantageous to use the cycle timing as a means of effecting necessary bypassing of jammed stacks. As indicated above, about one second elapses from the start of a power pulse to the point where the handle of microswitch 52 is released, and about three seconds elapse from the start of a cycle to its completion. The bypass circuitry of printed circuit board module 30 monitors switch 52 after the initiation of a power pulse to a card stack module. If the handle of switch 52 does not open within one second after the power pulse begins and then close within approximately 3.5 seconds after the power pulse begins, it may be inferred that the mechanism for driving that card stack module is jammed. (The monitoring is advantageously performed by using a 2-circuit switch, so that the non-power circuit is isolated from the power delivery circuit. The second circuit is advantageously NO, rather than NC like the power delivery circuit.) In this event, the bypass circuitry directs a power pulse to the next card stack module and repeats the foregoing operations. If this happens t times in succession, where t is the number of stacks, the inference is that the mechanisms for all stacks are jammed. The bypass circuitry then turns on the "sold out" sign and locks off coin slot 32.

When one of the stacks is out of cards, it sends an "out" or "empty" signal to module 30, as described above. The "out" signal has an "or" relation with the bypass circuitry described above, so that it too will cause a power pulse to be directed to the next stack. For the same reason, when all stacks are sending "out" signals to module 30, the "sold out" sign is turned on and the coin slot is locked off (as previously described).

OPERATION OF MOTOR CONTROL PRINTED CIRCUIT MODULE

The operation of motor control printed circuit board module 30 is as follows: One or more coin acceptance signals (pulses) are sent by the coin acceptor to module 30 when a customer deposits one or more coins. Transmission of a signal causes a delay of approximately 0.009 seconds to occur before another signal can be registered; this is to eliminate the effect of contact bounce of the coin acceptor's microswitch. The coin acceptance signals go to a memory location in a random-access memory chip (RAM) (e.g., 6116 chip). This location may be termed a "coin register." (The use of a counter or shift register is regarded as equivalent here.)

In the simplest embodiment, the coin acceptor accepts only one kind of coin, e.g., quarters, and one card is dispensed for one coin. In this case, the number of coins (quarters) deposited may be designated as N. A signal representing the number N is then what is stored in the coin register. In a more elaborate embodiment, the coin acceptor accepts various coins and one card is dispensed for some predetermined money value V (e.g., 40 cents). In this case, the first memory location reflects the amount of money deposited, N; and a microprocessor (Z80) in printed circuit board 30 and a program stored in read-only memory (ROM) (e.g., 2732 chip) in printed circuit board 30 divide N by V, and store the integer part of quantity N/V in a second memory location in the same RAM. If the latter integral value is N', the customer is to be issued N' cards. For the sake of simplicity, the following discussion will be on the basis of one coin (e.g., a quarter) per card; but those of ordinary skill in the art will readily appreciate how the discussion applies to the more elaborate embodiment (and they will substitute for what is said here of a coin register storing N, instead one storing N'). The term "1 card equivalent" is used hereafter to refer to one unit of coin value amounting to the price of one card (e.g., one quarter in the first example and 40 cents in the second; N and N' are integral multiples of 1 card equivalent).

When the coin register has a non-zero ($N>0$) state, the microprocessor and program in ROM direct that a pulse of predetermined duration be delivered at the output of printed circuit board 30, to trigger a motor 54. As indicated above, an appropriate value of the duration of this trigger pulse has been found to be one second for the equipment described herein. The one second can be determined by use of a clock circuit, such as a 74LS04 chip/crystal (20 MHz) oscillator and 74LS290 chip acting in conjunction with the Z80 microprocessor. (Instead, the one second pulse could be developed by using a Schmitt Trigger circuit.)

The pulse must be increased in power to be useable to drive motor 54. This may advantageously be accomplished by using the pulse delivered from printed circuit board 30 to drive a triac (or SCR's or power transistors; a relay could also be used). The resulting power pulse is directed to one of the card stack driver units, more specifically to the input power port of motor 54 of the selected stack. (The power input port of the motor can receive power either from the power pulse or from switch 52.)

The length of the power pulse to trigger operation of the motor should be long enough for the motor to drive slide plate 50 forward far enough to cause switch 52 to take over the control of the supply of power to the motor. But the pulse should not be so long that a complete cycle occurs in which the slide plate goes past the "home" position of its cycle and begins a new cycle. As indicated, approximately one second has been found satisfactory for the triggering pulse, for the triggering pulse and the length of a full cycle is approximately three seconds. (The duration of the triggering pulse must not be substantially longer than three seconds or else a second longitudinal cycle of the slide plate could take place.)

As previously indicated, the low voltage pulse of printed circuit board 30 is converted to a 110 vac power pulse by means of an optoisolator. This signal is used to control a triac which controls the motor. After the motor has completed a full cycle, the handle of switch 52 closes again. The state of switch 52 is monitored by the microprocessor and program of printed circuit board 30. When the handle of switch 52 is reclosed, N of the coin register is decremented by 1, so that N becomes $N-1$ (i.e., $N := N-1$). (The decrementing can occur elsewhere during the cycle if that is deemed advantageous, but it is considered more advantageous to decrement the coin register only when it is known that a card was delivered.)

To illustrate, if N is the coin register is set to 4 by the deposit of four coins, a card is delivered and N is decremented to 3. Then another card is delivered and N is decremented to 2. Then another card is delivered and N is decremented to 1. Then another card is delivered and N is decremented to 0. Then nothing happens until more coins are deposited.

Module 30 contains circuitry for the selection of a card stack from which a card will be delivered to the customer. This could be done on a random number basis if it is desired to give the customer this element of chance. For example, the output of a free running zero to three clock can be tapped to select which of four stacks will deliver the card. (This is, in effect, a 1–4 random number generator). However, in the commercial embodiment of the invention now contemplated the stacks are selected in regular rotation. In this case, a dual type of D flip flop can be used to select a different motor station, each time it is pulsed. If it is desired, instead the first stack can always be used until it is exhausted and then the bypass circuitry will automatically direct all power pulses to the second stack until it too is exhausted, and so on. In this case, the means for directing the power pulse to a card stack is the same as the bypass circuitry (i.e., they are combined).

It will thus be seen that the object set forth above, among those made apparent from the preceding description, are efficiently attained. Since certain changes may be made in carrying out the above methods, and in the constructions set forth, without departing from the spirit and scope of the present invention, it is intended that all matter contained in the above description and shown in the accompanying drawings shall be interpreted as illustrative and not restrictive. It is also to be understood that the following claims are intended to cover all of the generic and specific features of the invention which, as a matter of language, might be said to fall therebetween.

What is claimed and desired to be secured by United States Letters Patent is:

1. A coin-operated card dispensing system comprising, in combination:

a coin acceptor, which is adapted for receiving one or more coins from a customer and which produces one or more coin output signals representative of the value of the coins received from the customer;

a coin register which receives said coin output signals and stores a coin value signal representative of the value of the coins received from the customer;

a power pulse generator activated by a non-zero status of said coin value signal;

a card stack module comprising a plurality of card stacks, each of which said card stacks is associated with a card driver unit that comprises:

a motor having a power input port adapted to receive power pulses from said power pulse generator;

a gear device which is coupled to said motor and which increases the torque and decreases the units of angular rotation delivered by said motor, said gear device having an output shaft;

an eccentric unit which is coupled to said output shaft and which converts the rotary motion of said motor and said gear device to a longitudinal motion;

a slide plate which is coupled to said eccentric unit and which is longitudinally driven by said eccentric unit back and forth between a first position and a second position; and a power delivery circuit having a power delivery control means that causes said power delivery circuit to be in an open circuit state when said slide plate is at said first position of said slide plate and which power delivery control means causes said power delivery circuit to be in a closed circuit state when said slide plate longitudinally moves away from said first position, said power delivery circuit being so connected as to deliver power to said power input port of said motor when and only when said power control circuit is caused to be in a closed circuit state;

and each of which said card stacks contains a substantially vertical stack of substantially horizontally disposed cards, the bottommost card being positioned to be driven out of said card stack for delivery to the customer by the longitudinal motion of said slide plate to said second position;

pulse duration control means for controlling the duration of said power pulses to be (1) at least as long as the time it takes for said slide plate to be driven (a) from said first position where said slide plate causes said power delivery circuit to be in an open circuit state, (b) to a position sufficiently displaced therefrom so that said power delivery control means causes said power delivery circuit to be in a closed circuit state, but (2) not substantially longer than the time it takes for said slide plate to traverse a complete longitudinal cycle from said first to said second to said first position;

means for decrementing by 1 card equivalent said coin value signal stored in said coin register, for each time that a said slide plate of a said card driver unit traverses a complete cycle and delivers a card; and power pulse direction means for directing each said power pulse to a said power input port of said motor of one of said card driver units.

2. The system of claim 1 wherein said power delivery circuit is a switch and said power delivery control means is the switch handle of said switch, and wherein the longitudinal motion of said slide plate causes a motion of said switch handle so as to turn said switch off or on.

3. The system of claim 1 wherein there is included means for inhibiting the activation of said power pulse generator and consequent initiation of a later power pulse directed to a said card driver unit at any time after the initiation of an earlier power pulse directed to said card driver unit, there elapses an interval of time that is at least substantially as great as the time it takes for said slide plate to traverse a complete longitudinal cycle.

4. The system of claim 1 wherein each said card stack contains an out detector that produces an "out" signal whenever said card stack is out of said cards, and wherein said "out" signal is fed to electronic circuitry that directs a said power pulse to a said card driver unit other than the one whose out detector is producing said "out" signal.

5. The system of claim 4 wherein when all said out detectors are producing said "out" signals, a "sold out" signal is produced representing the fact that the entire system is out of cards.

6. The system of claim 5 wherein said "sold out" signal causes an indicator to appear which indicates to the customer that the system is out of cards.

7. The system of claim 5 wherein said "sold out" signal causes placement of a barrier to prevent further acceptance of coins by said coin acceptor.

8. The system of claim 1 wherein a musical tune generator sends audio signals to a loudspeaker at or about the time when said slide plate drives said card out of said card stack for delivery to the customer.

9. A method of mechanically dispensing cards in response to coin deposits, comprising:

(1) accepting one or more coins from a customer, and producing one or more coin output signals representative of the value of the coins received from the customer;

(2) deriving from said coin output signals and storing in a coin register a coin value signal representative of the value of the coins received from the customer;

(3) generating a power pulse of a predetermined duration;

(4) delivering said power pulse to a motor, transmitting the rotary motion of said motor to a gear device which increases the torque and decreases the units of angular rotation delivered by said motor, transmitting the rotary motion of said gear device to an eccentric unit which converts the rotary motion of said motor and gear device to a longitudinal motion, and transmitting the longitudinal motion of said eccentric unit to a slide plate which is driven longitudinally by said eccentric between a first position and a second position;

(5) using the longitudinal motion of said slide plate away from said first position to close a power circuit that delivers power to said motor;

(6) directing said slide plate against the bottommost card of a substantially vertical stack of substantially horizontally disposed cards, so that said card is driven out of said card stack for delivery to the customer;

(7) returning said slide plate to said first position and thereby opening said power circuit and stopping said motor;

(8) decrementing by 1 card equivalent said coin value signal stored in said coin register;

(9) returning to step 3 and proceeding through steps 4, 5, 6, 7, and 8 until said coin value signal stored in said coin register has been decremented to zero;

said predetermined duration of said power pulse of step 3 being (a) at least as long as the time it takes for said slide plate to be driven from said first position to a position sufficiently displaced therefrom so that said power circuit is closed, but (b) not substantially longer than the time it takes for said slide plate to traverse a complete longitudinal cycle from said first to said second to said first position.

* * * * *